US008933388B2

(12) United States Patent
Chen et al.

(10) Patent No.: US 8,933,388 B2
(45) Date of Patent: Jan. 13, 2015

(54) GOODS DELIVERY SWITCH

(75) Inventors: Yun-Lung Chen, New Taipei (TW); Chin-Wen Yeh, New Taipei (TW); Yang Xiao, Wuhan (CN); Dun-Jun Zhou, Wuhan (CN)

(73) Assignee: Scienbizip Consulting (Shenzhen) Co., Ltd, Guangdong (CN)

( * ) Notice: Subject to any disclaimer, the term of this patent is extended or adjusted under 35 U.S.C. 154(b) by 302 days.

(21) Appl. No.: 13/605,318

(22) Filed: Sep. 6, 2012

(65) Prior Publication Data

US 2014/0048693 A1 Feb. 20, 2014

(30) Foreign Application Priority Data

Aug. 17, 2012 (CN) ..... 2012 1 0293638

(51) Int. Cl.
*H01J 40/14* (2006.01)

(52) U.S. Cl.
USPC ..... 250/222.1

(58) Field of Classification Search
USPC ..... 250/222.1, 239, 551, 559.12–559.15, 250/559.43; 156/574–579; 57/81
See application file for complete search history.

(56) References Cited

U.S. PATENT DOCUMENTS 3,812,372 A * 5/1974 Wirtz et al. ..... 250/559.4
4,549,086 A * 10/1985 Herzer ..... 250/559.12
5,017,797 A * 5/1991 Uramoto et al. ..... 250/559.43
6,173,749 B1 * 1/2001 Johnson ..... 156/574

* cited by examiner

*Primary Examiner* — Seung C Sohn
(74) *Attorney, Agent, or Firm* — Novak Druce Connolly Bove + Quigg LLP

(57) ABSTRACT

A goods delivery switch includes a bracket, a rotating member, a delivery member, a signal generator, a signal receiver, a blocking member, and a control unit. The rotating member includes a second blocking curved plane and a cutting plane. The delivery member is operable to rotating the rotating member. The blocking member includes a first curved plane and defines a through hole. The blocking member is slidable relative to the blocking member between a first position, where the rotating member is rotated, the first curved plane abuts the second curved plane, and the signal receiver receives an optical signal from the signal generator through the through hole, and a second position, where the first curved plane abuts the cutting plane, the optical signal is blocked by the blocking member, and the control unit controls the delivery member to stop operating, relative to the bracket.

20 Claims, 5 Drawing Sheets

GOODS DELIVERY SWITCH

BACKGROUND

1. Technical Field

The present disclosure relates to goods delivery switches, and particularly to a goods delivery switch in an automatic vending machine.

2. Description of Related Art

In an automatic vending machine, a delivery assembly is used for pushing goods out of a goods channel. The delivery assembly includes a spring and a motor. The motor is rotatable to rotate the spring, to move the goods out of the goods channel. A micro switch is used for stopping the motor after the goods is moved out of the goods channel. However, a position of the micro switch must be accurate, and a sensitivity of the micro switch must be adjusted often. Otherwise, the motor may not be stopped and always be rotated to move the goods out. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
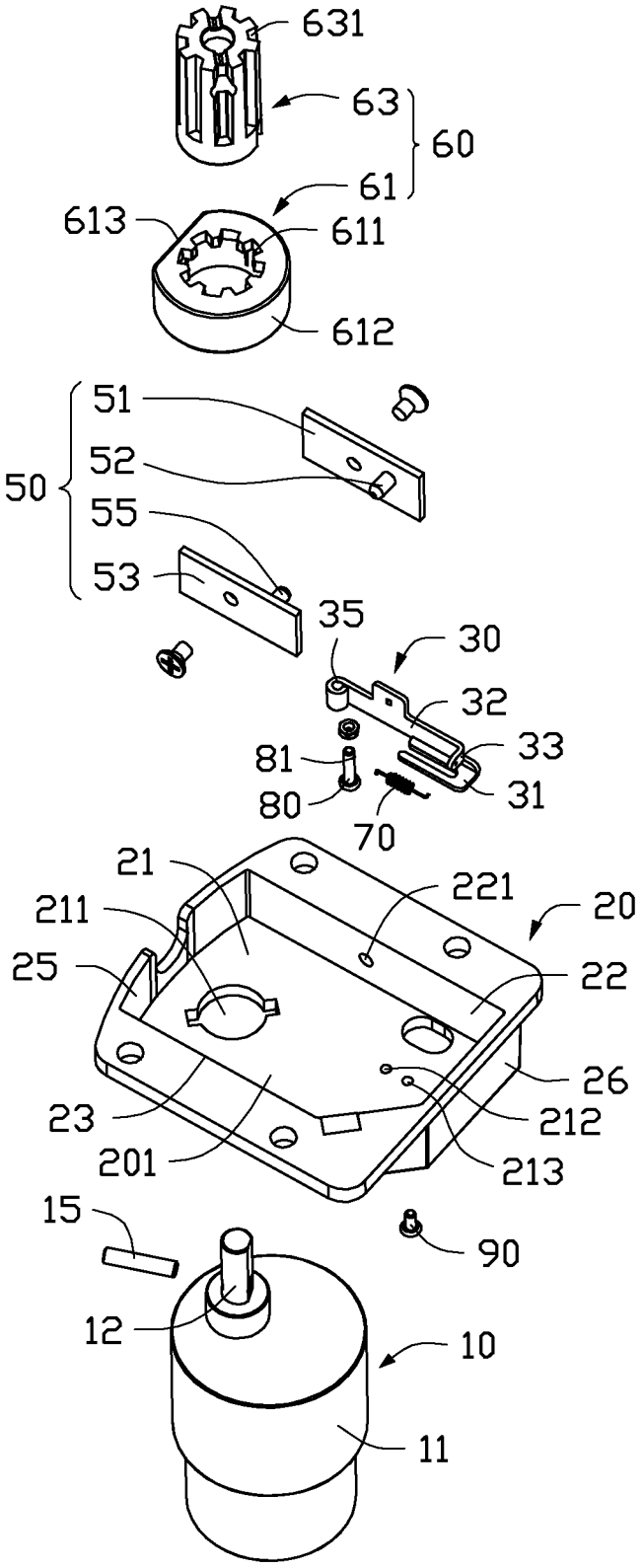
FIG. 1 is an exploded, isometric view of one embodiment of a goods delivery switch.

Referring to FIG. 1, a goods delivery switch in accordance with an embodiment is shown. The goods delivery switch includes a delivery member 10, a bracket 20, a blocking member 30, a signal transceiver 50, and a rotating assembly 60.

The delivery member 10 includes a motor 11 and a shaft 12 rotatably mounted to the motor 11.

The bracket 20 defines a receiving space 201. The receiving space 201 is defined by a bottom plate 21, a front plate 22, a rear plate 23, a first side plate 25, and a second side plate 26 together. The front plate 22, the rear plate 23, the first side plate 25, and the second side plate 26 extend perpendicularly from four edges of the bottom plate 21. In one embodiment, the front plate 22 is substantially parallel to the rear plate 23, and the first side plate 25 is substantially parallel to the second side plate 26 and substantially perpendicular to the front plate 22 and the rear plate 23.

The bottom plate 21 defines an opening 211, a first locking hole 212, and a second locking hole 213. The opening 211 is adjacent to the first side plate 25. The first locking hole 212 and the second locking hole 213 are adjacent to the second side plate 26. The front plate 22 defines a first installation hole 221. The rear plate 23 defines a second installation hole (not shown).

Figure 2:
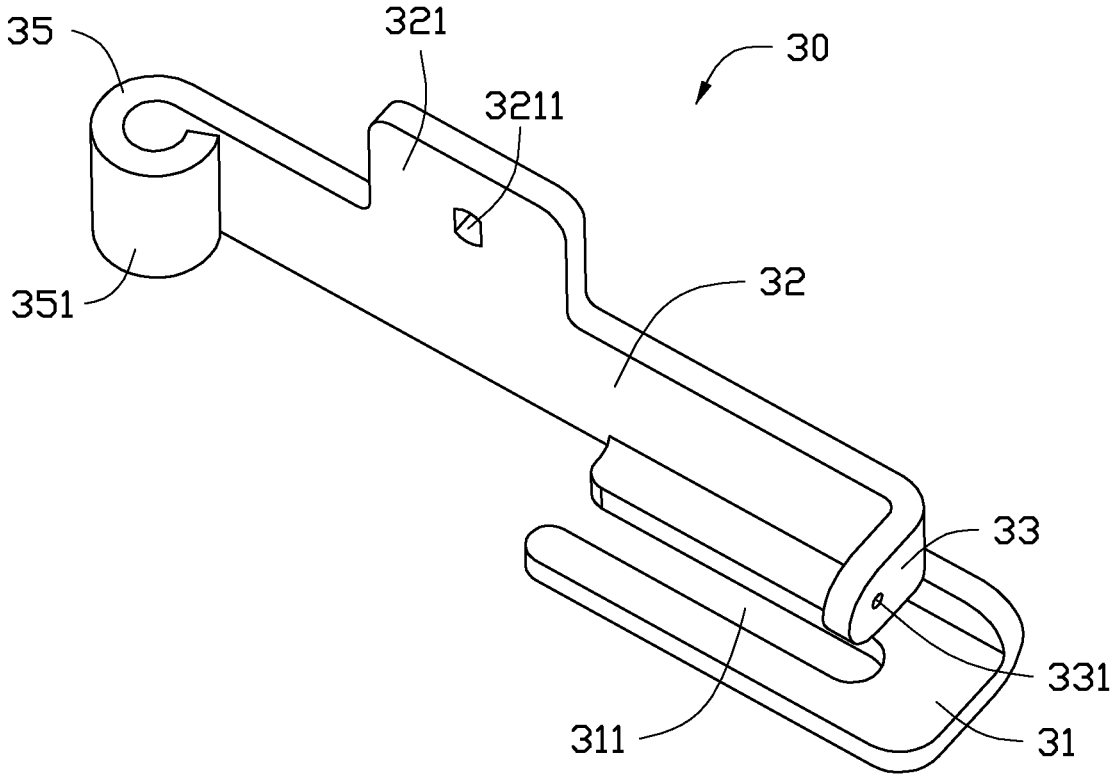
FIG. 2 shows an isometric view of a blocking member of the goods delivery switch of FIG. 1.

FIG. 1 and FIG. 2 show the blocking member 30 of the embodiment. The blocking member 30 includes a base plate 31 and a connecting plate 32 perpendicularly extending from a side edge of the base plate 31. The base plate 31 defines a sliding slot 311. A blocking piece 321 extends from a top edge of the connecting plate 32. The blocking piece 321 defines a through hole 3211. A flange 33 is bent from a first side edge of the connecting plate 32. The flange 33 defines a first mounting hole 331. A blocking portion 35 is bent from a second side edge of the connecting plate 32. The blocking portion 35 includes a first curved plane 351. In one embodiment, the flange 33 is substantially perpendicular to the blocking piece 321.

The signal transceiver 50 includes a first mounting piece 51, a signal generator 52, a second mounting piece 53, and a signal receiver 55. The signal generator 52 is secured to the first mounting piece 51 and is capable of producing an optical signal. The signal receiver 55 is secured to the second mounting piece 53 and capable of receiving the optical signal.

The rotating assembly 60 includes a rotating member 61 and an installation member 63. An outer surface of the rotating member 61 includes a second curved plane 612 and a cutting plane 613 connected to the second curved plane 612. The rotating member 61 defines a plurality of latching slots 611. The installation member 63 includes a plurality of teeth 631. The installation member 63 is used for securing a pushing member (not shown). The pushing member is used for placing goods and pushing the goods out of a goods channel when rotated. In one embodiment, the cutting plane 613 may be a flat plane or concave.

Figure 3:
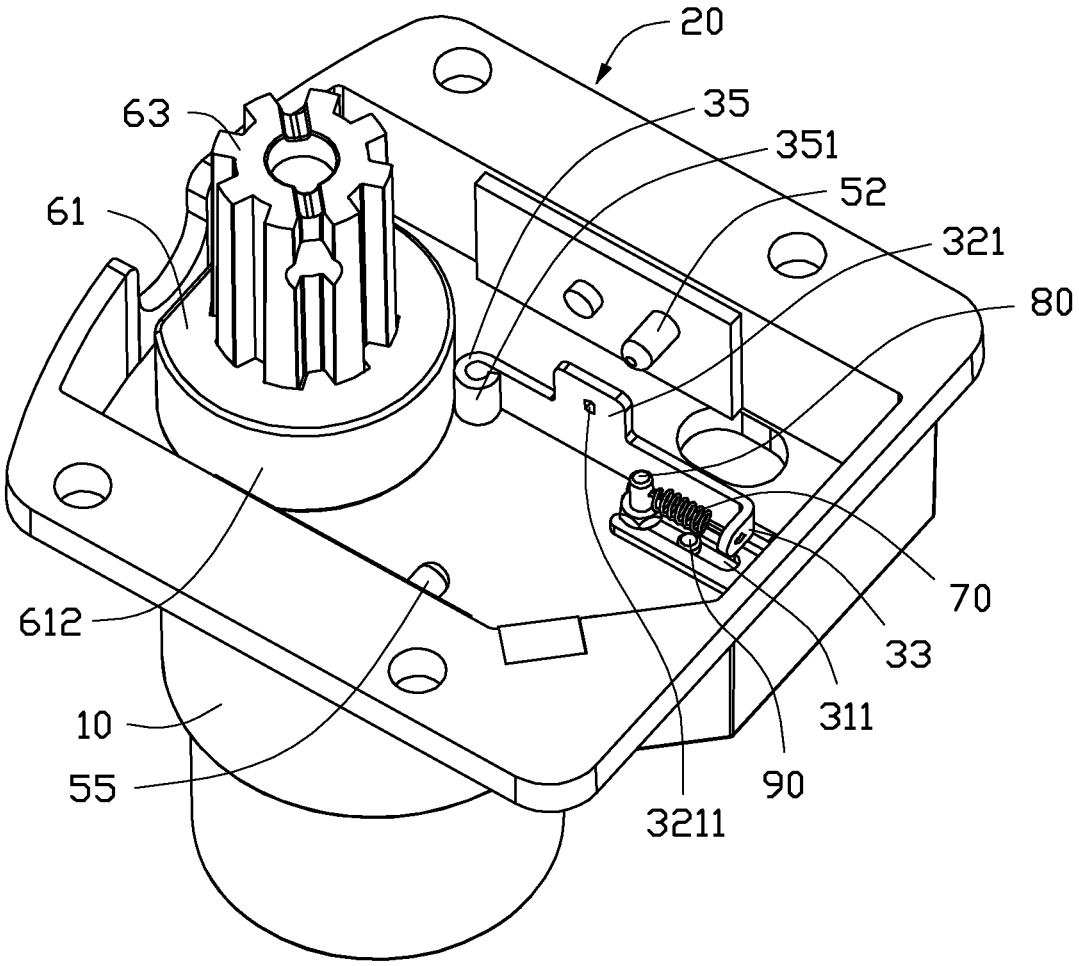
FIG. 3 is an assembled, isometric view of the goods delivery switch of FIG. 1, shown in one state.
Figure 4:
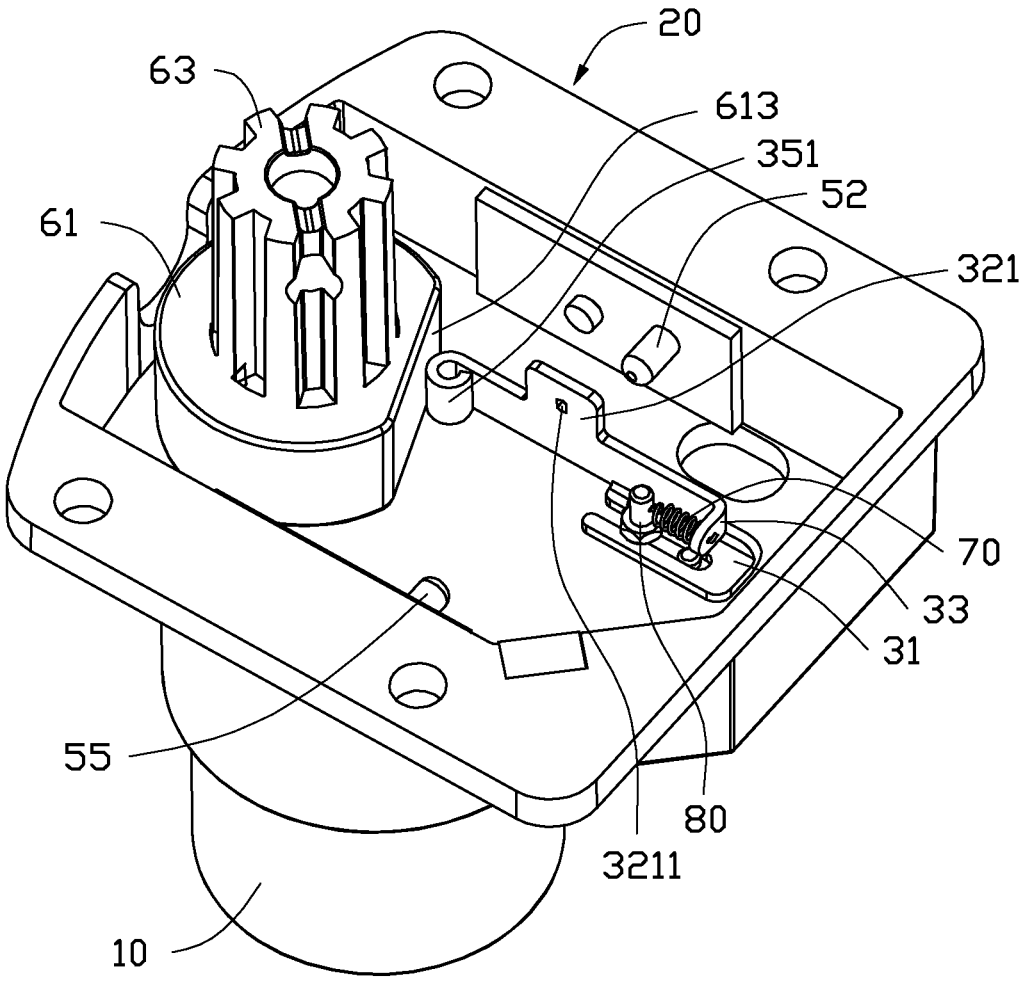
FIG. 4 is another assembled, isometric view of the goods delivery switch of FIG. 1, shown in another state.

FIG. 3 and FIG. 4 show that, in assembly, the shaft 12 of the delivery member 10 extends out of the opening 211 from a bottom end of the bracket 20. The delivery member 61 is placed in the receiving space 201 and secured to the shaft 12 by a pin 15. The installation member 63 is secured to the rotating member 61, and each tooth 631 is engaged in the latching slot 611. A positioning member 80 is secured to the bottom plate 21, and a part of the positioning member 80 extends out of the first locking hole 212. The positioning member 80 defines a first positioning hole 81. A locking member 90 is secured to the second locking hole 213, and a part of the locking member 90 extends out of the second locking hole 213. The first mounting piece 51 is secured to the front plate 22. The second mounting piece 53 is secured to the rear plate 23. The blocking member 30 is placed into the receiving space 201 adjacent to the bottom plate 21, and the positioning member 80 and the locking member 90 are aligned with the sliding slot 311. A first end of a resilient member 70 is engaged in the positioning hole 81. A second end of the resilient member 70 is engaged in the first mounting hole 331. The first curved plane 351 abuts the outer surface of the rotating member 61. In one embodiment, the resilient member 70 is an extension spring.

Figure 5:
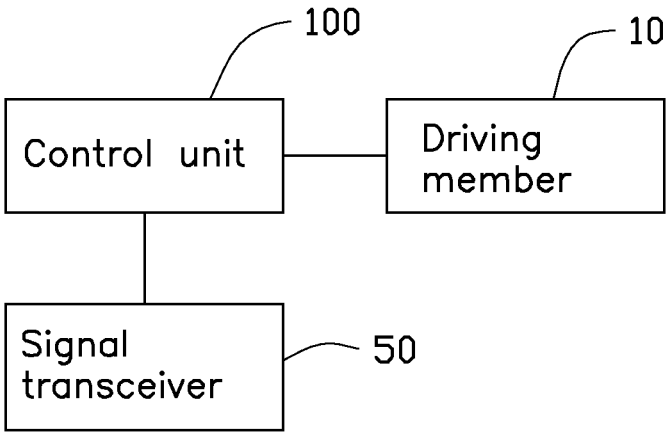
FIG. 5 is a block diagram of the goods delivery switch of FIG. 1.

FIG. 5 shows a block diagram of the goods delivery switch. The goods delivery switch further includes a control unit 100. The control unit 100 is connected to the signal transceiver 50 and the delivery member 10. The control unit 100 is configured for controlling the delivery member 10 to operate and receive a signal sent from the signal receiver 55 to control the delivery member 10 to stop operating.

Referring to FIGS. 3-5, in use, when a goods is needed, the control unit 100 drives the motor 11 to work pushing the goods out. The motor 11 rotates the rotating assembly 60 through the shaft 12. In this position, the first curved plane 351 abuts the second curved plane 612, and the resilient member is elastically deformed. At the same time, the blocking member 30 is in a first position, and the through hole 3211 is aligned with the signal generator 52 and the signal receiver 55. The rotating member 61 is rotated relative to the blocking member 30 until the first curved plane 351 slides over the second curved plane 612. In this process, the blocking member 30 is always in the first position, the first curved plane 351 always abuts the second curved plane 612, and the signal receiver 55 receives the optical signal from the signal generator 52 and sends the optical signal to the control unit 100. A first distance is defined between the flange 33 and the second side plate 26.

When the first curved plane 351 slides over the second curved plane 612, the goods is pushed out. In this position, the resilient member 70 restores to exert elastic force to slide the blocking member 30 towards the cutting plane 613. The positioning member 80 and the locking member 90 is slid along the sliding slot 311 relative to the blocking member 30 until the first curved plane 351 abuts the cutting plane 613. In this position, the second blocking member 30 is in a second position. A second distance is defined between the flange 33 and the second side plate 26, the optical signal is blocked by the blocking piece 321, the signal receiver 55 cannot receive the optical signal, and the control unit 100 controls the delivery member 10 to stop operating. Thus, the rotating assembly 60 stops rotating and stops pushing the goods out. The first distance is smaller than the second distance.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and the arrangement of parts within the principles of the disclosure, to the full extent indicated by the broad general meaning of the terms in which the appended claims are expressed.

What is claimed is:

1. A goods delivery switch, comprising:

a bracket;

a rotating member secured to the bracket, adapted to rotate a spring, and comprising a second blocking curved plane and a cutting plane;

a delivery member secured to the bracket and capable of rotating the rotating member;

a signal generator secured to the bracket and capable of producing an optical signal;

a signal receiver secured to the bracket and capable of receiving the optical signal;

a blocking member secured to the bracket and comprising a first curved plane and defining a through hole; and a control unit capable of controlling the delivery member to operate and stop operating;

wherein the blocking member is slidable relative to the bracket between a first position and a second position; when the blocking member is in the first position, the rotating member is rotated relative to the blocking member, the first curved plane abuts the second curved plane, and the signal receiver receives the optical signal through the through hole; when the blocking member is in the second position, the first curved plane abuts the cutting plane, the optical signal is blocked by the blocking member, and the control unit controls the delivery member to stop operating.

2. The goods delivery switch of claim 1, wherein when the rotating member is rotated until the cutting plane abuts against the first curved plane, the blocking member is slid relative to the bracket from the first position to the second position.

3. The goods delivery switch of claim 1, wherein when the control unit controls the rotating member to rotate, the blocking member is slid relative to the bracket from the second position to the first position.

4. The goods delivery switch of claim 1, further comprising a resilient member and a positioning member, wherein the positioning member is secured to the bracket; a first end of the resilient member is secured to the positioning member, and a second end of the resilient member is secured to the blocking member; when the blocking member is in the first position, the resilient member is elastically deformed; and when the resilient member restores, the resilient member slides the blocking member from the first position to the second position.

5. The goods delivery switch of claim 4, wherein the bracket defines a receiving space, and the receiving space is defined by a bottom plate, a front plate, a rear plate, a first side plate, and a second side plate together; the front plate, the rear plate, the first side plate, and the second side plate extend from four edges of the bottom plate; the signal generator is secured to the front plate; the signal receiver is secured to the rear plate; and the positioning member is secured to the bottom plate.

6. The goods delivery switch of claim 5, further comprising a locking member, wherein the locking member is secured to the bottom plate; the bottom plate further comprises a base plate, the base plate defines a sliding slot, and the locking member is slidable relative to the blocking member along the sliding slot.

7. The goods delivery switch of claim 5, wherein the blocking member further comprises a connecting plate, a blocking portion extending from a first side edge of the connecting plate, and a flange extending from a second side edge of the connecting plate; the first side edge is substantially parallel to the second side edge; the first curved plane is located on an outer surface of the blocking portion; the flange defines a mounting hole, and a second end of the resilient member is engaged in the mounting hole.

8. The goods delivery switch of claim 7, wherein the blocking member further comprises a blocking piece extending from a top edge of the connecting plate; the through hole is defined in the blocking piece; the blocking piece is substantially parallel to the front plate and the rear plate; when the blocking member is in the second position, the blocking piece blocks the optical signal; and the top edge of the connecting plate is substantially perpendicular to the first side edge and the second side edge.

9. The goods delivery switch of claim 7, wherein the rotating member is adjacent to the first side plate; the flange is substantially parallel to the second side plate; when the blocking member is in the first position, a first distance is defined between the flange and the second side plate; when the blocking member is in the second position, a second distance is defined between the flange and the second side plate; and the first distance is smaller than the second distance.

10. The goods delivery switch of claim 1, wherein the cutting plane is a flat plane or concave.

11. A goods delivery switch, comprising:

a bracket;

a rotating member secured to the bracket, adapted to rotate a spring, and comprising a second blocking curved plane and a cutting plane;

a delivery member secured to the bracket and capable of rotating the rotating member;

a signal generator secured to the bracket and capable of producing an optical signal;

a signal receiver secured to the bracket and capable of receiving the optical signal;

a blocking member secured to the bracket and comprising a first curved plane and defining a through hole; and a control unit capable of controlling the delivery member to operate and stop operating;

wherein when the control unit controls the delivery member to operate, the rotating member is rotated relative to the blocking member, the first curved plane abuts the second curved plane, and the signal receiver receives the optical signal through the through hole; when the second curved plane is rotated over the first curved plane, the blocking member is slid towards and abuts the cutting plane, the optical signal is blocked by the blocking member, and the control unit controls the delivery member to stop operating.

12. The goods delivery switch of claim 11, wherein the blocking member is slidable relative to the bracket between a first position and a second position; when the blocking member is in the first position, the first curved plane abuts the second curved plane; when the blocking member is in the second position, the first curved plane abuts the cutting plane.

13. The goods delivery switch of claim 12, wherein when the rotating member is rotated until the cutting plane abuts against the first curved plane, the blocking member is slid relative to the bracket from the first position to the second position; when the control unit controls the rotating member to rotate, the blocking member is slid relative to the bracket from the second position to the first position.

14. The goods delivery switch of claim 12, further comprising a resilient member and a positioning member, wherein the positioning member is secured to the bracket; a first end of the resilient member is secured to the positioning member, and a second end of the resilient member is secured to the blocking member; when the blocking member is in the first position, the resilient member is elastically deformed, and when the resilient member restores, the resilient member slides the blocking member from the first position to the second position.

15. The goods delivery switch of claim 14, wherein the bracket defines a receiving space, and the receiving space is defined by a bottom plate, a front plate, a rear plate, a first side plate, and a second side plate together; the front plate, the rear plate, the first side plate, and the second side plate extend from four edges of the bottom plate; the signal generator is secured to the front plate; the signal receiver is secured to the rear plate; and the positioning member is secured to the bottom plate.

16. The goods delivery switch of claim 15, further comprising a locking member, wherein the locking member is secured to the bottom plate; the bottom plate further comprises a base plate, the base plate defines a sliding slot, and the locking member is slidable relative to the blocking member along the sliding slot.

17. The goods delivery switch of claim 15, wherein the blocking member further comprises a connecting plate, a blocking portion extending from a first side edge of the connecting plate, and a flange extending from a second side edge of the connecting plate; the first side edge is substantially parallel to the second side edge; the first curved plane is located on an outer surface of the blocking portion; the flange defines a mounting hole, and a second end of the resilient member is engaged in the mounting hole.

18. The goods delivery switch of claim 17, wherein the blocking member further comprises a blocking piece extending from a top edge of the connecting plate; the through hole is defined in the blocking piece; the blocking piece is substantially parallel to the front plate and the rear plate; when the blocking member is in the second position, the blocking piece blocks the optical signal; and the top edge is substantially perpendicular to the first side edge and the second side edge.

19. The goods delivery switch of claim 17, wherein the rotating member is adjacent to the first side plate; the flange is substantially parallel to the second side plate; when the blocking member is in the first position, a first distance is defined between the flange and the second side plate; when the blocking member is in the second position, a second distance is defined between the flange and the second side plate; and the first distance is smaller than the second distance.

20. The goods delivery switch of claim 11, wherein the cutting plane is a flat plane or concave.

* * * * *